US010335920B2

(12) United States Patent
Hsieh et al.

(10) Patent No.: US 10,335,920 B2
(45) Date of Patent: Jul. 2, 2019

(54) MULTIPLE NOZZLE SLURRY DISPENSE SCHEME

(71) Applicant: Taiwan Semiconductor Manufacturing Company, Ltd., Hsin-Chu (TW)

(72) Inventors: Chih-Hsuan Hsieh, Hsin-Chu (TW); Tseng-Hsuan Huang, Zhubei (TW); Chen-Hsiang Liao, Cyonglin Township (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 0 days.

(21) Appl. No.: 14/179,348

(22) Filed: Feb. 12, 2014

(65) Prior Publication Data

US 2015/0224626 A1 Aug. 13, 2015

(51) Int. Cl.

| | |
|---|---|
| ***B24B 57/02*** | (2006.01) |
| ***B24B 37/34*** | (2012.01) |
| ***B24B 53/017*** | (2012.01) |

(52) U.S. Cl.

CPC ..... *B24B 57/02* (2013.01); *B24B 37/34* (2013.01); *B24B 53/017* (2013.01)

(58) Field of Classification Search

CPC ..... B24B 57/02; B24B 37/04; B24B 53/017
USPC ..... 451/60, 287, 56, 446
See application file for complete search history.

(56) References Cited

U.S. PATENT DOCUMENTS

| | | | | |
|---|---|---|---|---|
| 6,398,627 | B1 * | 6/2002 | Chiou et al. | 451/72 |
| 6,506,098 | B1 * | 1/2003 | Ho | B24B 37/04 156/345.12 |
| 6,984,166 | B2 * | 1/2006 | Maury | B24B 57/02 451/285 |
| 7,708,622 | B2 * | 5/2010 | Ramarajan | B24B 57/02 451/443 |
| 8,277,286 | B2 * | 10/2012 | Hung | B24B 37/04 451/287 |
| 2002/0090896 | A1 * | 7/2002 | Li | B24B 53/017 451/56 |
| 2010/0112917 | A1 * | 5/2010 | Leighton et al. | 451/446 |

* cited by examiner

*Primary Examiner* — Monica S Carter
*Assistant Examiner* — Lauren M Beronja
(74) *Attorney, Agent, or Firm* — Slater Matsil, LLP

(57) ABSTRACT

An apparatus includes a slurry dispensing arm, multiple nozzles formed on the slurry dispensing arm, and a slurry supply module connected to the slurry dispensing arm. The slurry supply module is configured to provide slurry to the multiple nozzles and the multiple nozzles are configured to dispense the slurry.

20 Claims, 2 Drawing Sheets

MULTIPLE NOZZLE SLURRY DISPENSE SCHEME

BACKGROUND

The present disclosure relates generally to an integrated circuit fabrication and more particularly to a slurry dispensing scheme.

For a chemical mechanical polishing (CMP) process, slurry is used with a polishing pad to polish a wafer. The slurry flow on the polishing pad influences the removal rate, uniformity, and cost. A slurry dispensing scheme to improve uniformity and save cost is desired.

BRIEF DESCRIPTION OF THE DRAWINGS

Reference is now made to the following descriptions taken in conjunction with the accompanying drawings, in which.

DETAILED DESCRIPTION

Figure 1:
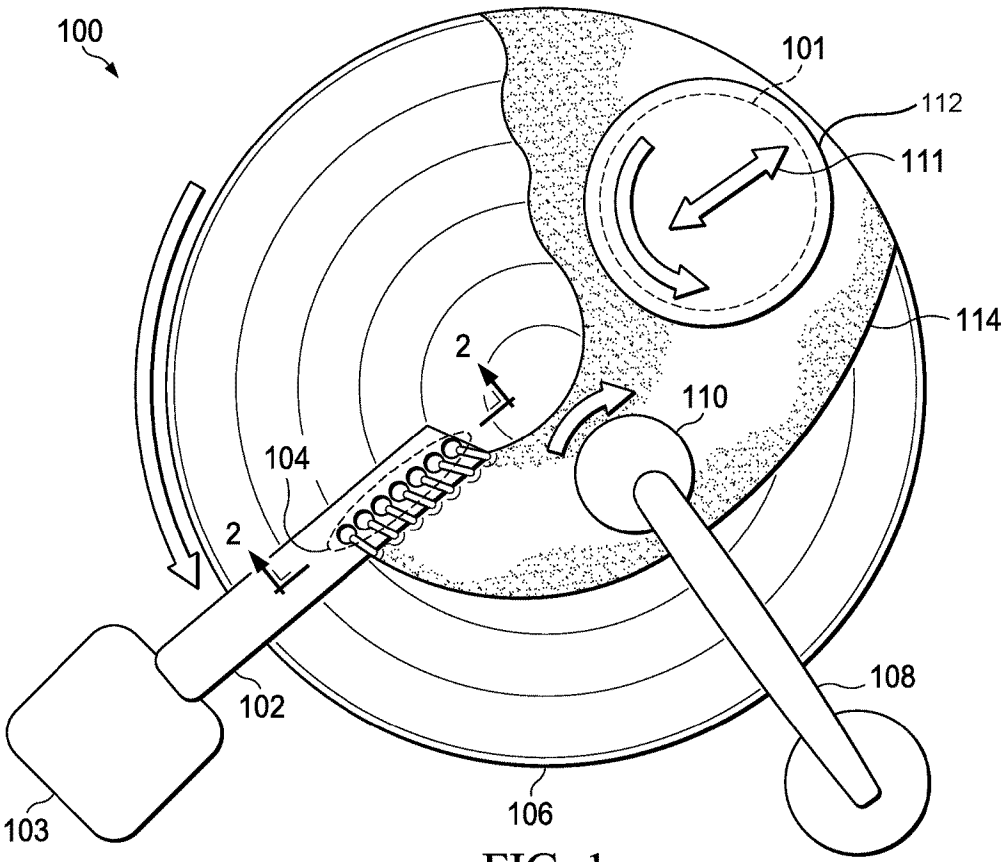
FIG. 1 is a schematic diagram of an exemplary multiple nozzle slurry dispensing scheme according to some embodiments.

The making and using of various embodiments are discussed in detail below. It should be appreciated, however, that the present disclosure provides many applicable inventive concepts that can be embodied in a wide variety of specific contexts. The specific embodiments discussed are merely illustrative of specific ways to make and use, and do not limit the scope of the disclosure.

In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact. In addition, spatially relative terms, for example, "lower," "upper," "horizontal," "vertical," "above," "over," "below," "beneath," "up," "down," "top," "bottom," etc. as well as derivatives thereof (e.g., "horizontally," "downwardly," "upwardly," etc.) are used for ease of the present disclosure of one features relationship to another feature. The spatially relative terms are intended to cover different orientations of the device including the features.

FIG. 1 is a schematic diagram of a chemical mechanical polishing (CMP) set up 100 with an exemplary multiple nozzle slurry dispensing scheme according to some embodiments. The CMP setup 100 includes a slurry dispensing arm 102, multiple nozzles 104 formed on the slurry dispensing arm 102, a slurry supply module 103 connected to the slurry dispensing arm 102, a polishing pad 106, a pad conditioner 110, a pad conditioner arm 108, and a wafer holder 112. As shown in FIG. 1, in some embodiments, wafer holder 112 can be positioned above a polishing surface of polishing pad 106 on an opposite side of the polishing pad than the slurry dispensing arm 102, such that the dispensed slurry 114 can spread out after being dispensed to be under the whole of the wafer.

The slurry supply module 103 is configured to provide slurry 114 to the multiple nozzles 104 through the slurry dispensing arm 102, and the slurry 114 is dispensed from the multiple nozzles 104 to the polishing pad 106. The multiple nozzles are facing down toward the polishing pad 106 in some embodiments. In some embodiments, the multiple nozzles are facing upward away from the polishing pad 106, such as pictured in FIG. 1.

The polishing pad 106, the wafer holder 112, and the pad conditioner 110 rotate during the polishing process in some embodiments. A wafer 101 that is being polished is loaded upside-down in the wafer holder 112 (indicated by wafer 101 being illustrated with dotted lines, as wafer 101 is under wafer holder 112 from the perspective illustrated in FIG. 1). The wafer 101 is pressed against the polishing pad 106 during the polishing process. During the process of loading and unloading the wafer 101 onto the wafer holder 112, the wafer 101 can be held by vacuum by the wafer holder 112 to prevent unwanted particles from building up on the wafer surface.

For the polishing process, the slurry 114 is dispensed on the polishing pad 106 from the multiple nozzles of the slurry dispensing arm 102. Both the polishing pad 106 and the wafer holder 112 are then rotated and the wafer holder 112 is kept oscillating as indicated by an arrow 111 in some embodiments. A downward pressure/force is applied to the wafer holder 112, pushing the wafer 101 against the polishing pad 106. The down force can be an average force or a local pressure can be applied, and the down force depends on the contact area and the surface structures of the wafer 101 and the polishing pad 106.

The polishing pad 106 is made from porous polymeric materials with a pore size between 30 μm and 50 μm in some embodiments. The polishing pad 106 wears down in the polishing process, and is regularly reconditioned by the pad conditioner 110. The pad conditioner 110 has abrasive material such as diamond on its surface to maintain the desired roughness of the polishing pad 106.

By using multiple nozzles 104 of the slurry dispensing arm 102, the slurry 114 can be distributed on the polishing pad 106 relatively uniformly, e.g., compared to a single nozzle dispensing apparatus. In some embodiments, the slurry is distributed across the polishing pad such that an inner edge of the slurry is distributed on the polishing pad in a wave outline and an outer edge of the slurry is distributed on the polishing pad in a curvilinear outline, such as shown in FIG. 1. Also, the dispensed slurry 114 can cover the polishing pad 106 faster than with single nozzle dispensing and reduce the amount of wasted slurry. In one example, the exemplary slurry dispensing arm 102 with 7 nozzles 104 saved 30% of slurry usage by dispensing 70 ml/min, compared to 100 ml/min of a conventional single nozzle dispenser.

Figure 2:
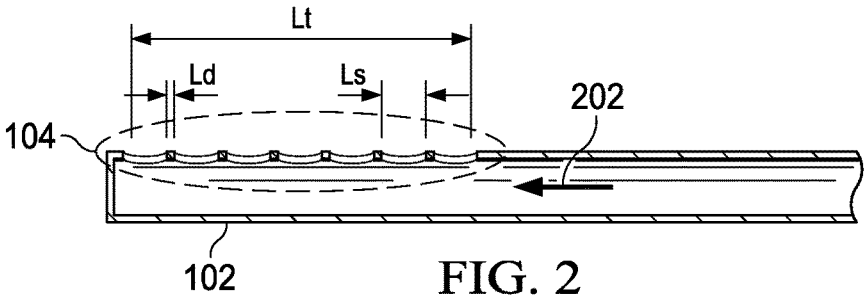
FIG. 2 is a schematic diagram of an exemplary slurry dispensing arm in FIG. 1 according to some embodiments.

FIG. 2 is a schematic diagram of an exemplary slurry dispensing arm 102 in FIG. 1 according to some embodiments. The slurry dispensing arm 102 has multiple nozzles 104. An arrow 202 indicates the direction of slurry movement. As indicated by the arrow 202, the direction of slurry movement in the slurry dispensing arm 102 may be in only one direction from the proximal or base end of the slurry arm toward the distal end of the slurry arm where the multiple nozzles 104 are located. The slurry dispensing arm 102 comprises plastic, metal, or any other suitable material. The number of the multiple nozzles 104 ranges from 5 to 10 in some embodiments. In other embodiments, the number of the multiple nozzles 104 can be different, e.g., 2-4 or more than 10, depending on applications. The multiple nozzles 104 can begin from a distal end of the slurry dispensing arm 102 spaced back toward a proximal end of the slurry dispensing arm 102. In some embodiments, the direction of slurry movement 202 through the slurry dispensing arm 102 is from the proximal end toward the distal end of the slurry dispensing arm 102. As can be seen in FIG. 2, a slurry outlet for each of the nozzles 104 may be disposed in a same plane as a surface of the slurry dispensing arm 102. The surface may be the top surface of the arm (such as illustrated in FIG. 2) or the bottom surface of the arm (such as discussed above when the multiple nozzles 104 are facing down toward the polishing pad 106). FIG. 2 also illustrates that the slurry dispensing arm 102 may have a concave surface between each adjacent pair of the multiple nozzles 104.

In one example, the slurry dispensing arm 102 has 7 nozzles (or holes) with a 1 mm diameter Ld and a 7 mm spacing Ls for a polishing process of 8 inch wafer size. In another example, the slurry dispensing arm 102 has 10 nozzles (or holes) with similar dimensions for a polishing process of 12 inch wafer size.

The percentage of the total combined length Lt of the multiple nozzles 104 of the slurry dispensing arm 102 over the wafer radius of the wafer under polishing ranges from 20% to 70% in some embodiments. The percentage ranges from 40% to 60% in some embodiments. The exemplary slurry dispensing arm 102 with the multiple nozzles 104 saved slurry usage by 10%-50% compared to conventional slurry dispensing arms. In one example, the exemplary slurry dispensing arm 102 with 7 nozzles 104 saved 30% of slurry usage by dispensing 70 ml/min, compared to 100 ml/min of a conventional single nozzle dispenser. In this example, the slurry dispensing arm 102 has 7 nozzles (or holes) with a 1 mm diameter Ld and a 7 mm spacing Ls for a polishing process of 8 inch wafer size. In some embodiments, the combined length Lt of the multiple nozzles 104 on the slurry dispensing arm 102 ranges from 45 mm to 80 mm.

Figure 3:
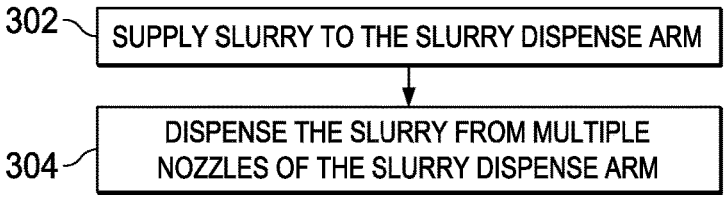
FIG. 3 is a flowchart of an operation method of the exemplary multiple nozzle slurry dispensing scheme in FIG. 1 according to some embodiments.

FIG. 3 is a flowchart of an operation method of the exemplary multiple nozzle slurry dispense scheme in FIG. 1 according to some embodiments. At step 302, slurry 114 is supplied to the slurry dispense arm 102 (from the slurry supply module 103). At step 304, the slurry 114 is dispensed from the multiple nozzles 104 of the slurry dispense arm 102. Both the polishing pad 106 and the wafer holder 112 are then rotated and the wafer holder 112 is kept oscillating as indicated by an arrow 111 in FIG. 1 in some embodiments. A downward pressure/force is applied to the wafer holder 112, pushing the wafer 101 against the polishing pad 106. The down force can be an average force or a local pressure can be applied, and the down force depends on the contact area and the surface structures of the wafer 101 and the polishing pad 106.

According to some embodiments, an apparatus includes a slurry dispensing arm, multiple nozzles formed on the slurry dispensing arm, and a slurry supply module connected to the slurry dispensing arm. The slurry supply module is configured to provide slurry to the multiple nozzles and the multiple nozzles are configured to dispense the slurry.

According to some embodiments, a method includes supplying slurry to a slurry dispensing arm that has multiple nozzles. The slurry is dispensed from the multiple nozzles of the slurry dispensing arm to a polishing pad.

According to some embodiments, an apparatus includes a slurry dispensing arm, multiple nozzles formed on the slurry dispensing arm, and a polishing pad. The slurry dispensing arm is configured to provide slurry to the multiple nozzles and the multiple nozzles are configured to dispense the slurry on the polishing pad.

A skilled person in the art will appreciate that there can be many embodiment variations of this disclosure. Although the embodiments and their features have been described in detail, it should be understood that various changes, substitutions, and alterations can be made herein without departing from the spirit and scope of the embodiments. Moreover, the scope of the present application is not intended to be limited to the particular embodiments of the process, machine, manufacture, and composition of matter, means, methods, and steps described in the specification. As one of ordinary skill in the art will readily appreciate from the disclosed embodiments, processes, machines, manufacture, compositions of matter, means, methods, or steps, presently existing or later to be developed, that perform substantially the same function or achieve substantially the same result as the corresponding embodiments described herein may be utilized according to the present disclosure.

The above method embodiment shows exemplary steps, but they are not necessarily required to be performed in the order shown. Steps may be added, replaced, changed order, and/or eliminated as appropriate, in accordance with the spirit and scope of embodiment of the disclosure. Embodiments that combine different claims and/or different embodiments are within the scope of the disclosure and will be apparent to those skilled in the art after reviewing this disclosure.

What is claimed is:

1. An apparatus, comprising:

a polishing pad having a polishing surface;

a wafer holder positioned at one side of the polishing pad above the polishing surface;

a slurry dispensing arm positioned above the polishing surface at an opposite side of the polishing pad from the wafer holder;

multiple nozzles formed on the slurry dispensing arm, the nozzles being spaced about 7 mm from one another along the slurry dispensing arm and covering a total length along the slurry dispensing arm of about 45 mm to about 80 mm, wherein the slurry dispensing arm is configured to polish a wafer, wherein a slurry outlet for each of the nozzles is oriented in an upward direction away from the polishing pad; and a slurry supply module connected to the slurry dispensing arm, wherein the slurry supply module is configured to provide slurry through the slurry dispensing arm in one direction only toward a distal end of the slurry dispensing arm without returning to a base end of the slurry dispensing arm to the multiple nozzles and the multiple nozzles are configured to dispense the slurry onto the polishing pad on the opposite side of the polishing pad from the wafer holder.

2. The apparatus of claim 1, wherein the polishing pad is configured to rotate during the polishing process.

3. The apparatus of claim 1, wherein the wafer holder is configured to rotate the wafer during the polishing process.

4. The apparatus of claim 1, further comprising a polishing pad conditioner configured to condition the polishing pad, wherein the polishing pad conditioner is configured to rotate during conditioning of the polishing pad.

5. The apparatus of claim 1, wherein the slurry dispensing arm comprises plastic or metal.

6. The apparatus of claim 1, wherein a number of the multiple nozzles ranges from 5 to 10.

7. The apparatus of claim 1, wherein the multiple nozzles are holes formed on the slurry dispensing arm.

8. A method, comprising:

supplying slurry to a slurry dispensing arm that has multiple nozzles spaced about 7 mm from one another along the slurry dispensing arm, wherein the slurry dispensing arm is configured to polish a wafer, wherein the multiple nozzles are formed on a top surface of the slurry dispensing arm;

dispensing the slurry from the multiple nozzles of the slurry dispensing arm in an upward direction away from a polishing pad, the slurry flowing to a polishing surface of the polishing pad at an area of the polishing surface opposite to where a wafer holder is located; and rotating the polishing pad to spread the slurry across the polishing pad.

9. The method of claim 8, further comprising:

loading a wafer to a wafer holder; and rotating the wafer.

10. The method of claim 9, further comprising moving the wafer back and forth while rotating the wafer.

11. The method of claim 8, further comprising conditioning the polishing pad using a polishing pad conditioner, wherein the polishing pad conditioner is rotated.

12. An apparatus, comprising:

a slurry dispensing arm configured to provide slurry in one direction through the slurry dispensing arm from a base of the slurry dispensing arm toward a distal end of the slurry dispensing arm without returning slurry from the distal end of the slurry dispensing arm back through the base of the slurry dispensing arm;

multiple nozzles formed on the slurry dispensing arm, wherein the slurry dispensing arm is configured to be used in a polishing process to polish a wafer that has a wafer radius and a percentage of a combined length of the multiple nozzles of the slurry dispensing arm over the wafer radius ranges from 20% to 70%, wherein a slurry outlet for each of the nozzles is disposed at a top surface of the slurry dispensing arm, wherein each of the multiple nozzles is disposed nearer to the distal end of the slurry dispensing arm than the base of the slurry dispensing arm; and a polishing pad, wherein the slurry dispensing arm is configured to provide slurry to the multiple nozzles and the multiple nozzles are configured to dispense the slurry in an upward direction away from the polishing pad and flowing onto the polishing pad, wherein the slurry dispensing arm is positioned above the polishing pad on a side opposite to a wafer holder, wherein the slurry is dispensed on the polishing pad on the side opposite to the wafer holder, and wherein the apparatus is configured to rotate the polishing pad to spread the slurry located at an inner portion of the polishing pad.

13. The apparatus of claim 12, further comprising a wafer holder configured to hold the wafer during a polishing process.

14. The apparatus of claim 12, further comprising:

a wafer holder configured to hold the wafer during the polishing process, wherein the wafer holder is configured to rotate the wafer during the polishing process; and a polishing pad conditioner configured to condition the polishing pad, wherein the polishing pad conditioner is configured to rotate during conditioning of the polishing pad.

15. The apparatus of claim 1, wherein the apparatus is configured to dispense the slurry across the polishing pad by rotating the polishing pad such that an inner edge of the slurry on the polishing pad has a wave outline and an outer edge of the slurry has a curvilinear outline.

16. The apparatus of claim 1, wherein a percentage of a combined length of the multiple nozzles of the slurry dispensing arm over a radius of the wafer ranges from 20% to 70%.

17. The method of claim 8, wherein an inner edge of the slurry on the polishing pad has a wave outline, and wherein an outer edge of the slurry on the polishing pad has a curvilinear outline.

18. The method of claim 8, wherein a percentage of a combined length of the multiple nozzles of the slurry dispensing arm over a radius of the wafer ranges from 20% to 70%.

19. The apparatus of claim 12, wherein a percentage of a combined length of the multiple nozzles of the slurry dispensing arm over the wafer radius ranges from 40% to 60%.

20. The apparatus of claim 19, wherein the apparatus is configured to dispense slurry over the top surface of the slurry dispensing arm and running over a side of the slurry dispensing arm and depositing on the polishing pad, and wherein the apparatus is configured to rotate the polishing pad to distribute the slurry such that an outer edge of the slurry on the polishing pad has a curvilinear outline and an inner edge of the slurry on the polishing pad has a wave outline.

* * * * *